US010026313B2

(12) United States Patent
Hayee et al.

(10) Patent No.: US 10,026,313 B2
(45) Date of Patent: Jul. 17, 2018

(54) DSRC-EQUIPPED PORTABLE CHANGEABLE SIGN

(71) Applicant: Regents of the University of Minnesota, Minneapolis, MN (US)

(72) Inventors: M. Imran Hayee, Duluth, MN (US); Umair Ibrahim, Riverside, CA (US); Eil Kwon, Shoreview, MN (US)

(73) Assignee: Regents of the University of Minnesota, Minneapolis, MN (US)

( * ) Notice: Subject to any disclaimer, the term of this patent is extended or adjusted under 35 U.S.C. 154(b) by 209 days.

(21) Appl. No.: 14/593,179

(22) Filed: Jan. 9, 2015

(65) Prior Publication Data

US 2015/0199902 A1 Jul. 16, 2015

Related U.S. Application Data

(60) Provisional application No. 61/926,010, filed on Jan. 10, 2014.

(51) Int. Cl.

| | |
|---|---|
| ***G08G 1/095*** | (2006.01) |
| ***G08G 1/09*** | (2006.01) |
| ***G08G 1/0955*** | (2006.01) |

(52) U.S. Cl.

CPC ..... *G08G 1/091* (2013.01); *G08G 1/0955* (2013.01)

(58) Field of Classification Search

None

See application file for complete search history.

(56) References Cited

U.S. PATENT DOCUMENTS

| | | | | |
|---|---|---|---|---|
| 4,727,371 | A * | 2/1988 | Wulkowicz | G08G 1/075 340/905 |
| 6,061,628 | A * | 5/2000 | Hayashi | G01C 21/32 340/990 |
| 8,520,695 | B1 | 8/2013 | Rubin et al. | |
| 2002/0008637 | A1 * | 1/2002 | Lemelson | G08G 1/07 340/907 |
| 2004/0075582 | A1 * | 4/2004 | Bergan | G08G 1/01 340/936 |

(Continued)

FOREIGN PATENT DOCUMENTS

| | | | |
|---|---|---|---|
| CA | 2794990 | A1 | 6/2013 |
| CN | 102625239 | A | 8/2012 |

OTHER PUBLICATIONS

Maitipe, B.R. et al. Development and Field 1 Demonstration of DSRC-Based V2I Traffic Information System for the Work Zone. In Transportation Research Record: Journal of Transportation Research Board, Transportation Research Board of the National Academies, Washington, D.C., 2011.

(Continued)

*Primary Examiner* — Julie Lieu

(74) *Attorney, Agent, or Firm* — Theodore M. Magee; Westman, Champlin & Koehler, P.A.

(57) ABSTRACT

A road sign includes a display and a controller having a memory for storing messages to be shown on the display and providing signals to the display to show at least one stored message on the display. A communication link receives information issued for a vehicle, generates a message from the received information, and provides the generated message to the controller with instructions to show the generated message on the display.

6 Claims, 6 Drawing Sheets

(56) References Cited

U.S. PATENT DOCUMENTS

| | | | | |
|---|---|---|---|---|
| 2005/0267671 | A1* | 12/2005 | Matsumoto | B62D 15/029 701/117 |
| 2007/0010934 | A1* | 1/2007 | Breitenberger | G08G 1/0104 701/117 |
| 2007/0194950 | A1* | 8/2007 | Boss | G08G 1/0962 340/905 |
| 2008/0218379 | A1* | 9/2008 | Boss | G08G 1/0962 340/905 |
| 2009/0234859 | A1 | 9/2009 | Grigsby et al. | |
| 2010/0188265 | A1 | 7/2010 | Hill et al. | |
| 2011/0199231 | A1* | 8/2011 | Loiselle | G09F 9/33 340/907 |
| 2012/0083995 | A1* | 4/2012 | Vorona | G08G 1/0104 701/119 |
| 2013/0018705 | A1* | 1/2013 | Heath | G08G 1/017 705/13 |
| 2013/0293422 | A1* | 11/2013 | Guner | G08G 1/017 342/386 |
| 2015/0126222 | A1* | 5/2015 | Ignatin | G01C 21/26 455/456.3 |
| 2015/0183440 | A1* | 7/2015 | Jackson | B60W 40/06 701/31.4 |
| 2016/0133131 | A1* | 5/2016 | Grimm | B60W 40/068 701/117 |

OTHER PUBLICATIONS

Maitipe, B.R. et al. Development and Field Demonstration of DSRC-Based V2I Work Zone Traffic Information System with V2V assistance. In Transportation Research Board's 91th Annual Meeting, Jan. 23-27, Washington, D.C. 2012.

Marfia, G et al. Vehicular congestion modeling and estimation for advanced traveler information systems. In proceedings of the International Federation for Information Processing Wireless Days WD-IFIP, Oct. 2010, pp. 1-5, 20-22.

Misener, J.A. et al. PATH Investigations in Vehicle-Roadside Cooperation and Safety: A Foundation for Safety and Vehicle-Infrastructure Integration Research. In proceedings of Intelligent Transportation Systems Conference (ITSC)'06. IEEE, 9-16. 2006.

Morgan, Y.L, Managing DSRC and WAVE standards Operations in a V2V Scenario, International of Vehicular Technology, 2010.

Nowakowski, C. et al. Evaluation of Real-Time Freeway End-of-Queue Alerting System to Promote Driver Situational Awareness. In Transportation Research Record: Journal of Transportation Research Board, No. 2324, Transportation Research Board of the National Academies, Washington, D.C., 2012, pp. 37-43, Mar. 2013.

Nowakowski, C. et al. A SafeTrip 21 Initiative: Networked Traveler Foresighted Driving Field Experiment Final Report. Technical Report UCB-ITS-PRR-2011-05. California Partners for Advanced Transit and Highways, University of California, Berkeley, 2010.

Pesti, G. et al. (2013). Simulation Based Evaluation of Dynamic Queue Warning System Performance. In Transportation Research Board 92nd Annual Meeting. No. 13-5086, Washington D.C. 2012.

Pollack, M. et al. Narrative text analysis to identify technologies to prevent motor vehicle crashes: Examples from military vehicles, Journal of Safety Research, No. 44, Feb. 2013, pp. 45-49.

Qian, Y. A Secure VANET Mac Protocol for DSRC Applications. In Proceedings of IEEE Globecom, 2008, New Orleans, Nov. 2008.

Shimura, A. et al. M. QoS Management Technique of Urgent Information 8 Provision in ITS Services using DSRC for Autonomous based Stations. IEICE Transactions on Information and Systems, Sep. 2008, vol. E91D, Issue: 9, pp. 2276-2284.

Ullman, G. L. et al. Development of a Field Guide for Portable Changeable Message Sign Use in Work Zones. Texas Transportation Institute, College Station, 2005.

van Eenennaam, E.M. et al.. Providing over-the-horizon awareness to driver support systems. In Proceedings of 4th IEEE Workshop on Vehicle to Vehicle Communications (V2VCOM), pp. 19-25, 2008.

Varaiya, P. What We've Learned About Highway Congestion. Access, vol. 27, 2005, pp. 2-9.

Wegener, A. TraCI: an interface for coupling road traffic and network simulators. In Proceedings of the 11th communications and networking simulation symposium (CNS '08). ACM, New York, NY, USA, 2008, 155-163.

Weng. J. et al. Rear-end crash potential estimation in the work zone merging areas. In Journal of Advanced Transportation, SN: 2042-3195, 2012.

Xiao, J. et al. Traffic incident detection using multiple-kernel support vector machines. In 3 Transportation Research Record: Journal of Transportation Research Board, No. 2324, Transportation Research Board of the National Academies, Washington, D.C., 2012, pp. 44-52, Mar. 2013.

Xu, Q. et al. Vehicle-to Vehicle Safety Messaging in DSRC. In Proceedings of 1st ACM Workshop on Vehicular Adhoc Networks (VANET), Oct. 2004.

Zhoe, H. et al. Vehicle platoon control in High-latency wireless communications environment: Model predictive control method. In Transportation Research Record: Journal of Transportation Research Board, No. 2324, Transportation Research Board of the National Academies, Washington, D.C., 2012, pp. 81-90, Mar. 2013.

http://www.caltrans.ca.gov/newtech/researchreports/reports/2009/portable_atis_con_ops_final_report.pdf.

http://trb.metapress.com/content/4885780436228757/.

http://trid.trb.org/view.aspx?id=1247059.

http://trid.trb.org/view.aspx?id=1241344.

http://www.cts.umn.edu/Publications/ResearchReports/reportdetail.html?id=2148.

http://www.cts.umn.edu/Publications/ResearchReports/reportdetail.html?id=2250.

ADDCO company website; model DLH1000-ALS. Date accessed: Jan. 2012. http://www.addco.com/en/products/traffic/portables/als/.

DSRC Committee of the Society of Automotive Engineers (SAE), "Dedicated short range message set (DSRC) dictionary," SAE, Warrendale, PA, Tech. Rep. Std. J2735, 2009.

Intelligent Transportation Systems in Work Zones: A Cross-Cutting Study. Integrated Work Zone Systems for Improving Travel Conditions and Safety. No. FHWA-OP-02-025. FHWA, Washington, D.C., 2002.

Intelligent Transportation Systems in Work Zones: A Case Study (Dynamic Lane Merge System). Report No. FHWA-HOP-04-033. U.S. Department of Transportation, Washington, DC 2004.

Manual on Uniform traffic control devices. Federal Highway Administration, U.S. Department of Transportation, Washington D.C., pp. 2A-2 to 2A-3 and 6F-25 and 6F-26, 2003.

Real-Time Work Zone Traffic Control System—Using an Automated Traffic Information System to Reduce Congestion and Improve Safety During Reconstruction of the I-55 Lake Springfield Bridge in Illinois Intelligent Transportation Systems in Work Zones: A Case Study, FHWA-HOP-04-018, 2004.

Research and Innovative Technology Administration ITS Research fact sheets. http://www.its.dot.gov/factsheets/dsrc_factsheet.htm . Accessed Aug. 1, 2011.

Abdel-Aty, M. et al. Comprehensive Analysis of Relationship between Real-Time Traffic Surveillance Data and Rear-End Crashes on Freeways. In Transportation Research Record: Journal of the Transportation Research Board, No. 1953, Transportation Research Board of the National Academies, Washington, D. C., 2006, pp. 31-40.

Alazawi, Z. et al.: Intelligent disaster management system based on cloud-enabled vehicular networks. In Proc. of 11th International Conference on ITS Telecommunications (ITST), Aug. 23-25, pp. 361-368, 2011.

Bai, F. et al. Reliability Analysis of DSRC Wireless Communication for Vehicle Safety. Intelligent Transportation Systems Conference, 2006. IEEE, pp. 355-362.

Büscher, M. et al. Intelligent mobility 1 systems: some socio-technical challenges and opportunities, in Communications Infrastructure: Systems and Applications in Europe, R. Mehmood, E. Cerqueira, R. Piesiewicz, and I. Chlamtac, Eds., pp. 140-152, 2009.

(56) References Cited

OTHER PUBLICATIONS

Bushman, R. et al.. Effect of Intelligent Transportation Systems in Work Zones: Evaluation of North Carolina Smart Work Zones. North Carolina Department of Transportation, NC. 2004.
Calabrese, F. et al. Real-Time Urban 22 Monitoring Using Cell Phones: A Case Study in Rome. IEEE Transactions on Intelligent Transportation Systems, vol. 12, No. 1, 2011, pp. 141-151.
Cheng, L., A fully mobile, GPS enabled, vehicle-to-vehicle measurement platform for characterization of the 5.9 GHz DSRC channel, Antennas and Propagation Society International Symposium, 2007, IEEE.
Cheng, L., A Roadside Scattering Model for the Vehicle-to-Vehicle Communication Channel, IEEE Journal on Selected Areas in Communication, 2013.
Chu, L et al. Evaluation of effectiveness of automated work zone information systems. In Transportation Research Record: Journal of Transportation Research Board, No. 1911, Transportation Research Board of the National Academies, Washington, D.C., 2005, pp. 73-81, Dec. 2009.
Coifman, B. et al. Vehicle Reidentification and Travel 1 Time Measurement on Congested Freeways. Transportation Research Part A: Policy and Practice, vol. 36, No. 10, 2002, 50 pp. 899-917.
Cowan, R.J. Useful headway models. Transportation Research, vol. 9, Issue 6, Dec. 1975.
Fang, C. Portable Intelligent Traffic Management System for Work Zones and Incident Management Systems: Best Practice Review. In proceedings of 11th International IEEE Conference on Intelligent Transportation Systems, ITSC 2008., pp. 563-568, Oct. 12-15, 2008.
Fambro, B. D. et al. Transportation research circular E-C003: A new stopping sight distance model for use in highway geometric design. In Transportation Research Board of the National Academies, Washington, DC, 1998.
Faouzi, N. et al. Motorway Travel Time Prediction Based on Toll Data and Weather Effect Integration. IET Intelligent Transport Systems, vol. 4, No. 4, 2010, pp. 338-345.
Farah, H. et al. Evaluation of the effect of cooperative infrastructure-to-vehicle systems on driver behavior, Transportation Research Part C: Emerging Technologies, vol. 21, Issue 1, Apr. 2012, pp. 42-31 56.
Fontaine, M.D. Guidelines for Application of Portable Work Zone Intelligent Transportation Systems. In Transportation Research Record: Journal of Transportation Research Board, No. 1824, Transportation Research Board of the National Academies, Washington, D.C., 2003, pp. 15-22, Mar. 2010.
Gartner, N. et al. Revised Monograph on Traffic Flow Theory, (8) Unsignalized Intersections. In Transportation Research Record: Journal of Transportation Research Board, Transportation Research Board of the National Academies, Washington, D.C., 2005.
Gates, T. J. et al. Analysis of Driver Behavior in Dilemma Zones at Signalized Intersections. In Transportation Research Record: Journal of the Transportation Research Board, No. 2030, Transportation Research Board of the National Academies, Washington D.C., 2007, pp. 29-39.
Haseman, R. J. et al. Real-Time Measurement of Travel Time Delay in Work Zones and Evaluation Metrics Using Bluetooth Probe Tracking. In Transportation Research Record: Journal of the Transportation Research Board, No. 2169, Transportation Research Board of the National Academies, Washington, D.C., 2010, pp. 40-53.
Hassan, Y. et al. Effect of vertical alignment on driver perception of horizontal curves. In Journal of Transportation Engineering 129.4 (2003): 399-407.
Herrera, J. C. et al. Evaluation of Traffic Data Obtained via GPS-enabled Mobile Phones: The Mobile Century Field Experiment. Transportation Research Part C: Emerging Technologies, vol. 18, No. 4, 2010, pp. 568-583.
Hsu, C. et al. Verification of On-Line Vehicle Collision Avoidance Warning System using DSRC. World Academy of Science, Engineering and Technology, issue 55, Jul. 2009.
Huang, L. et al. Adaptive inter-vehicle communication control for cooperative safety systems. IEEE Network, vol. 24, No. 1, pp. 6-13, Jan. 2010.
Ibrahim, U. et al. Hybrid DSRC-PCMS Traffic Information System for Work Zone—Development and Field Demonstration. In Transportation Research Board's 92nd Annual Meeting, Jan. 13-17, Washington, D.C. 2013.
Jia, C. et al. (2013). Evaluation of Alternative Technologies to Estimate Travel Time on Rural Interstates. In Transportation Research Board 92nd Annual Meeting. No. 13-3892, Washington D.C. 2013.
Jiang, D. et al. Design of 5.9 GHz DSRC-based Vehicular Safety Communication. IEEE Wireless Communications magazine, vol. 13 No. 5, pp. 36-43, Oct. 2006.
Kandarpa, A.R. et al. Final Report: Vehicle Infrastructure Integration Proof of Concept (POC) Test—Executive Summary. Booz Allen Hamilton, McLean, VA. Feb. 2009.
Kwong, K. et al. Arterial Travel Time Estimation Based on Vehicle Re-identification Using Wireless Magnetic Sensors. Transportation Research Part C: Emerging Technologies, vol. 17, No. 6, 2009, pp. 586-606.
Lajunen, T, et al. Does traffic congestion increase driver aggression? In Transportation Research Part F: Traffic Psychology and Behavior, vol. 2, Issue 4, pp. 225-236, Dec. 1999.
Layton, R. et al. Stopping Sight Distance, Kiewit Center for Infrastructure and Transportation, Oregon Department of Transportation, Apr. 2012.
Lee, E. et al. Automated Work Zone Information System (AWIS) on Urban Freeway Rehabilitation: California Implementation. In Transportation Research Board (TRB) 85th Annual Meeting, Washington, D.C., 2005.
Liu, Y. et al. Performance evaluation of intersection warning system using a vehicle traffic and wireless simulator. In Proceedings of IEEE Intelligent Vehicles Symposium, vol., No., pp. 171-176, Jun. 6-8, 2005.
Luttrell, T et al. Comparative Analysis Report: The Benefits of Using Intelligent Transportation Systems in Work Zones. FHWA-HOP-09-002.Washington, DC 2008: Federal Highway Administration.
Bowman, An Innovative Intelligent Awareness System for Roadway Workers Using Dedicated Short-Range Communications, Report prepared for the Research and Innovative Technology Administration (RITA), U.S. Department of Transportation, submitted by Virginia Tech Transportation Institute, Blacksburg, VA, 21 pages, Jan. 31, 2015.
Farrell et al., Differential GPS Reference Station Algorithm-design and Analysis, IEEE Transactions on Control Systems Technology, vol. 8, No. 3, May 2000, pp. 519-531.
Geronimo et al., Survey of Pedestrian Detection for Advanced Driver Assistance Systems, IEEE Transactions on Pattern Analysis and Machine Intelligence, vol. 32, No. 7, 2010, pp. 1239-1258.
Gressmann et al., Surround view pedestrian detection using heterogeneous classifier cascades, 14th International IEEE Conference on Intelligent Transportation Systems, Oct. 5-7, 2011.
Ibrahim, Development of a freeway queue detection and warning system using Ad-hoc control and DSRC based V2V Communication, Bentham Science Publishers, 2014, pp. 1-10.
Karsky, Comparing Four Methods of Correcting GPS Data: DGPS, WAAS, L-Band, and Post-processing, Report, Tech Tip 0471-2307-MTDC, U.S. Department of Agriculture, Forest Service, Missoula Technology and Development Center. Missoula, MT, 6 pages, Jul. 2004.
Kashif, Wireless Communication Technologies for ITS Applications, Topics in Automotive Networking, Communications Magazine, IEEE 48, No. 5, 2010, pp. 156-162.
Maitipe et al., Vehicle-to-Infastructure Traffic Information System for the Work Zone Based on Dedicated Short-Range Communication, Transportation Research Record, Journal of Transportation Research Board, No. 2243, pp. 67-73, 2011.
Maitipe et al., Vehicle-to-Infrastructure and Vehicle-to-Vehicle Information Systems in Work Zones, Transportation Research

(56) References Cited

OTHER PUBLICATIONS

Record: Journal of the Transportation Research Board, No. 2324, Transportation Research Board of the National Academies, Washington, D.C., pp. 125-132, 2012.
Maitipe et al., Development and Field Demonstration of DSRC: Based V2V-Assisted V2I Traffic Information System for the Work Zone, Jun. 2012, Intelligent Transportation Systems Institute Center for Transportation Studies University of Minnesota, 50 pages.
Maitipe et al., Development and Field Demonstration of DSRC-based V2I Work Zone Traffic Information System with V2V Assistance, Transportation Research Board's 91th Annual Meeting, Jan. 23-27, Washington, D.C. 2012, 14 pages.
Matosevic et al., Comparison of Accuracy using GPS and low-cost DGPS, IEEE Transactions on Instrumentation and Measurement, vol. 55, No. 5, Oct. 2006, pp. 1677-1683.
Minnesota Department of Transportation. Internet. Speed Limits in Work Zones Guidelines, Oct. 2014.(Accessed Jul. 11, 2015), http://www.dot.state.mn.us/speed/pdf/WZSpeedLimitGuideline.pdf, 25 pages.
Minnesota Department of Transportation. Internet. 2012 CMS Manual of Practice. Oct. 2012. (Accessed Jul. 11, 2015), http://dotapp7.dot.state.mn.us/edms/download?docId=1244587, 66 pages.
National Work Zone Safety, Information Clearinghouse, Internet, Guidelines on Managing Speeds in Work Zones, Roadway Safety Consortium (Access Jul. 2015), http://www.workzonesafety.org/files/documents/training/courses_programs/rsa_program/RSP Guidance Documents Download/RSP Speed Guidance Download.pdf, 12 pages.
OKI's GPS receiver with DSRC technology: http://oki.com/en/press/2009/01/z08113e.html, 2016, 1 page.
Rahman et al., Smartphone-based Forward Collision Warning Messages in Work Zones to Enhance Safety and Reduce Emissions. Presented at 94th Transportation Research Board Annual Meeting, Washington, D.C., Jan. 11-15, 2015, 20 pages.
Saleem, Analysis and Mitigation of Tropospheric Error Effect on GPS Positioning Using Real GPS Data, International Journal of Electronics and Electrical Engineering, vol. 2, No. 3, Sep. 2014, pp. 249-253.
Sebastien, Empirical IEEE 802.11 p Performance Evaluation on Test Tracks, Journal of Networks 9, No. 6, 2014, pp. 1485-1495.
U.S. Department of Transportation, Federal Highway Administration. Internet. High Accuracy-Nationwide Differential Global Positioning System Program Fact Sheet. FHWARD-03-39, 2003(Accessed Jul. 10, 2015), http://www.fhwa.dot.gov/publications/research/operations/03039/, 1 page.
U.S. Department of Transportation, National Highway Traffic Safety Administration. Internet. Vehicle Safety Communications—Applications (VSC-A), Final Report (Accessed Jun. 2016), http://www.nhtsa.gov/DOT/NHTSA/NVS/Crash%20Avoidance/Technical%20Publications/2011/811492A.pdf, 2011, 102 pages.
U.S. Department of Transportation, Intelligent Transportation Systems Joint Program Office. Internet. DSRC Communications Scalability Research Update, ITS-JPO Public Workshop Sep. 24, 2013 (Accessed Jun. 2016), http://www.its.dot.gov/presentations/CV_PublicMeeting2013/PDF/Day1_LukucInteroperability.pdf, 17 pages.
Worker Safety Data on US DoT website: http://www.ops.fhwa.dot.gov/wz/workersafety/, 2016, 2 pages.
Prosecution history of corresponding U.S. Appl. No. 14/593,172 including: Office Action dated Oct. 31, 2016.

* cited by examiner

DSRC-EQUIPPED PORTABLE CHANGEABLE SIGN

CROSS-REFERENCE TO RELATED APPLICATION

The present application is based on and claims the benefit of U.S. provisional patent application Ser. No. 61/926,010, filed Jan. 10, 2014, the content of which is hereby incorporated by reference in its entirety.

The Government has an interest in the patent as a result of funding derived from U.S. DOT/RITA Grant #DTRT06-G-0013.

BACKGROUND

Dedicated short range communication (DSRC) is a wireless communication technology used to convey traffic information between vehicles (vehicle-to-vehicle or V2V) and between vehicles and roadside infrastructure (vehicle-to-infrastructure or V2I).

Normally, DSRC-based work zone traffic information systems have two important components; (i) acquisition of traffic parameters such as travel time (TT) through the work zone and starting location of congestion (SLoC), and (ii) dissemination of these parameters to the vehicles coming toward the work zone congestion area. However, only those vehicles with DSRC capabilities can receive the disseminated traffic information. Vehicles that lack DSRC components are unable to receive or use such traffic information.

Portable Changeable Message Signs (PCMS) have been used extensively for traffic control, and to display crucial travel related information in the work zone environment. They are believed to command more of a driver's attention than static message signs and can be dynamically configured at any time through both local and remote means.

SUMMARY

A road sign includes a display and a controller having a memory for storing messages to be shown on the display and providing signals to the display to show at least one stored message on the display. A communication link receives information issued for a vehicle, generates a message from the received information, and provides the generated message to the controller with instructions to show the generated message on the display.

In a further embodiment, a includes a road sign receiving a message issued for a vehicle on a road and displaying messages based on information in the received message.

In a still further embodiment, a system includes a host that transmits information about congestion through a network of vehicles on a road, and a road sign positioned near the road that receives the information about the congestion and converts the information into at least one message displayed on the road sign.

DETAILED DESCRIPTION

A Portable Changeable Message Sign (PCMS) is provided that includes DSRC components to allow the PCMS to intercept messages transmitted for vehicles. The information in the intercepted messages is converted into instructions for a display controller in the PCMS. The instructions direct the display controller to generate one or more pixel maps that convey the intercepted information and to use the pixel maps to alter the display of the PCMS. The DSRC-equipped PCMSs are placed at strategic locations to disseminate the information for vehicles lacking DSRC capability.

Figure 1:
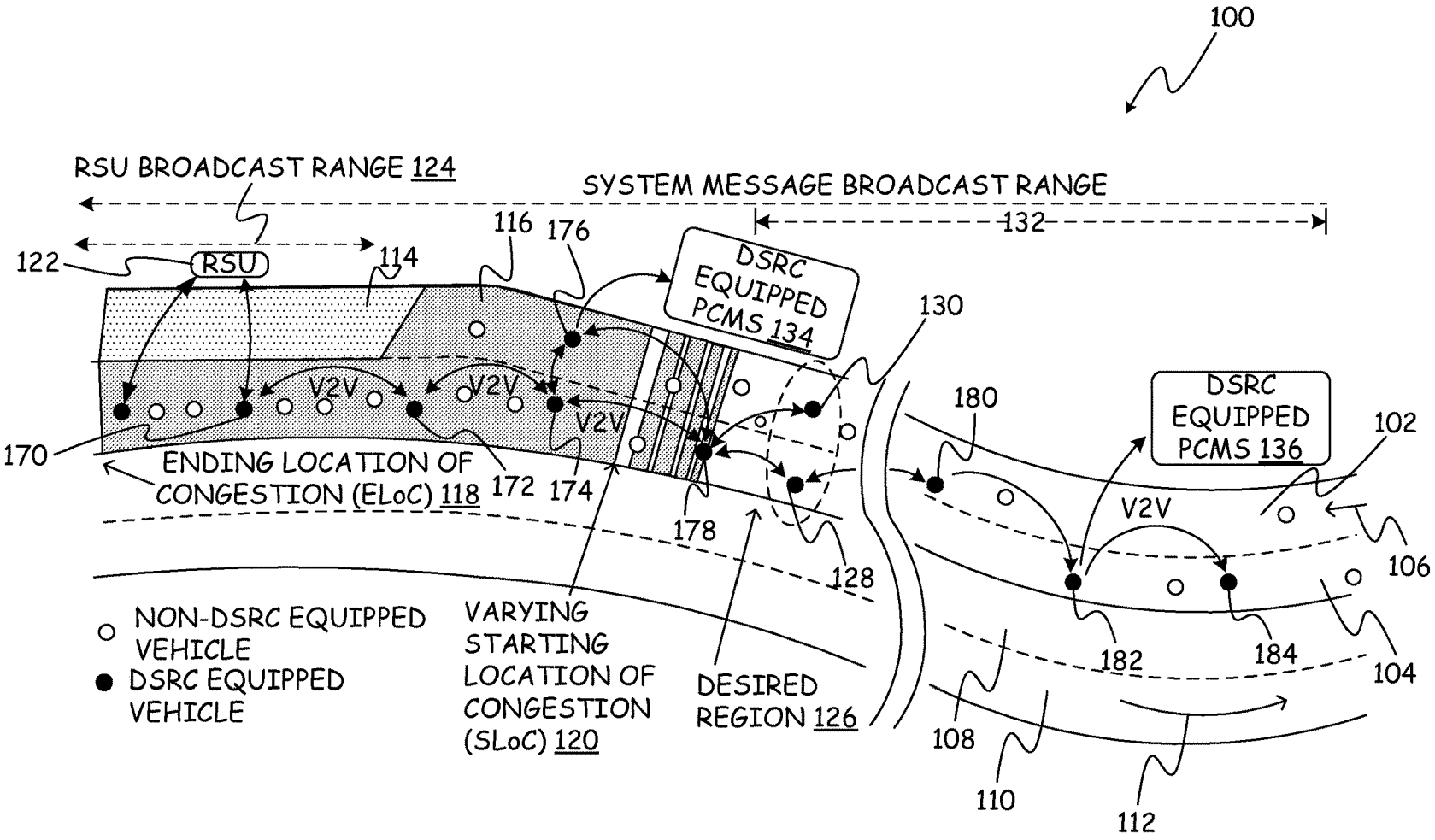
FIG. 1 is a plan view of a traffic environment in which embodiments are practiced.

FIG. 1 provides a plan view of a traffic environment 100 in which embodiments described below are implemented. In traffic environment 100, two lanes of traffic 102 and 104 move in a general direction 106, and two lanes of opposing traffic 108 and 110 move in a generally opposite direction 112. Vehicles in traffic lanes 102 and 104 that are equipped with DSRC components and thus can communicate with each other and with DSRC-equipped roadside units are depicted by solid circles while vehicles that are not DSRC equipped are shown as empty circles. In traffic lane 102, a work zone 114 obstructs the flow of traffic creating a congestion area 116. Congestion area 116 has an Ending Location of Congestion (ELoC) 118 that marks where traffic begins to flow freely again and a Starting Location of Congestion (SLoC) 120 where traffic has slowed from a free flow speed to a congested speed. The position of SLoC 120 varies as the density of vehicles approaching work zone 114 changes. In particular, as a greater density of vehicles approaches work zone 114, SLoC 120 moves further from ELoC 118 and congestion area 116 grows.

In the embodiment of FIG. 1, a portable DSRC-based, central RoadSide Unit (RSU) 122 is installed at a height such that it has a clear line of sight with vehicles that are within the direct wireless access range 124 of RSU 122. The location of central RSU 122 with respect to work zone 114 is determined such that RSU 122's wireless access range 124 on one side coincides with ELoC 118. For congestion due to work zones, the location of ELoC 118 is generally fixed.

Central RSU 122 is installed and initialized with typical user input parameters such as ELoC, posted speed limit, direction etc., according to the specific work zone environment. After being initialized, the software of central RSU 122 will control DSRC-based communications with all DSRC-equipped vehicles passing through congestion area 116 using V2I and/or V2V communication depending upon whether a vehicle is within or beyond direct wireless access range 124.

After central RSU 122 is initialized, central RSU 122 acts as a host that transmits information about congestion through a network of vehicles, such as vehicles 170, 172, 174, 176, 178, 128, 130, 180, 182 and 184. These vehicles act as a network of vehicles because each vehicle is equipped with DSRC components that allow the vehicles to transmit messages to each other and to relay messages from one vehicle to another vehicle in the same manner that nodes of a network relay messages.

To acquire information about the congestion, RSU 122 selects a DSRC-equipped vehicle to monitor to estimate the Transit Time (TT) through the congestion and the starting location of the congestion (SLoC) 120. At the time it is selected, the DSRC-equipped vehicle is preferably located well before any previously determined SLoC. The preferred area for selecting a DSRC-equipped vehicle to monitor is shown as Desired Region 126 (FIG. 1). Because the position of the SLoC could vary depending upon the traffic influx, central RSU 122 will move Desired Region 126 as the SLoC moves so that Desired Region 126 is always well before the previously determined SLoC.

To engage a vehicle for acquiring traffic information, central RSU 122 periodically transmits invitation messages to DSRC-equipped vehicles using a combination of V2I and V2V communication. The invitation message indicates that RSU 122 is looking for a vehicle to volunteer to send position information to RSU 122. The invitation includes a range of positions corresponding to Desired Region 126 that a vehicle must be in to accept the invitation. Each DSRC-equipped vehicle contains a position system such as a global positioning system (GPS) receiver that allows the vehicle to know its current position. DSRC-equipped vehicles that determine that they are within Desired Region 126, such as vehicles 128 and 130, will respond to the invitation messages by sending acknowledgements back to the central RSU 122. One of the responding DSRC-equipped vehicles is selected by central RSU 122 for acquiring traffic data.

As the selected DSRC-equipped vehicle enters and passes through congestion area 116, the vehicle periodically sends messages to central RSU 122 to convey the vehicle's current location and speed. Initially, the vehicle reports a free flow speed associated with travelling in one of lanes 102 or 104 without congestion. As the vehicle approaches SLoC 120, the vehicle decelerates so that when it reaches SLoC 120, the vehicle is traveling at a slower congestion speed. Central RSU 122 stores the location where the vehicle slows to the congestion speed as the new estimate of SLoC 120 and stores the time when the vehicle is at new SLoC 120 for later use in determining the Transit Time (TT). Central RSU 122 then monitors the location of the selected vehicle and identifies when the vehicle passes ELoC 118. Central RSU 122 then uses the difference between the time when the vehicle reached ELoC and the time when the vehicle was at new SLoC 120 to compute the Transit Time (TT) for passing through congestion area 116.

Although the description above provides one technique for identifying parameters of the congestion, those skilled in the art will recognize that other techniques and other parameters of the congestion may be utilized within the scope of the various embodiments.

Central RSU 122 periodically (e.g., every few seconds) broadcasts an information message or a sequence of information messages containing information about the congestion area. For example, these messages can include warnings such as "Lanes Closed Ahead" or "DUI Enforced" or "Curve Ahead", for example. The information messages can also include one or more of the latest travel parameters such as the Transit Time, the Starting Location of Congestion and/or the Ending Location of Congestion. These messages are sent from central RSU 122 to the vehicles within direct wireless access range 124 of central RSU 122. Although the messages are being transmitted to the vehicles within direct wireless access range 124, the messages may also be received by any DSRC-equipped PCMS that is located within direct wireless access range 124. Each receiving vehicle rebroadcasts the message to neighboring vehicles using vehicle-to-vehicle communication. This causes the messages to move backwards through the vehicles in congestion area 116 to the vehicles and DSRC-equipped PCMSs in free-flow area 132, which precedes congestion area 116. By adding the DSRC-equipped PCMSs at strategic locations on the roadside, drivers of vehicles lacking DSRC are able to take advantage of the information, such as warnings and updated TT and SLoC information, that RSU 122 provides in its messages. Depending upon the availability of the PCMSs, they can be located every couple of miles and/or just before an alternative route if present. The detailed guidelines for placement of PCMSs for different traffic scenarios are also provided in Manual on Uniform Traffic Control Devices (MUTCD). In FIG. 1, two DSRC-equipped PCMSs 134 and 136 are provided with PCMS 134 located in a region where vehicles are decelerating before SLoC 120 and PCMS 136 located in free flow area 132.

Normally, only one vehicle is selected and monitored at a time. Since the monitored vehicle must pass through congestion area 116 before the traffic parameters can be updated, the update period for the traffic parameters is the same as the Transit Time required to pass through congestion area 116. For example, if it takes an hour to pass through congestion area 116, the traffic parameters will only be updated once every hour. When the Transit Time exceeds a maximum allowed update period, some embodiments begin to monitor multiple vehicles in congestion area 116 so that the traffic parameters can be updated more often. In particular, an update period is set and at each update period, a new vehicle is added to the collection of vehicles being monitored. The new vehicle is in Desired Region 126 when it is selected and it is monitored as it enters and passes through congestion area 116. Thus, in such embodiments, the collection of monitored vehicles can include a vehicle that has not reached SLoC 120 yet, a vehicle that is in the middle of congestion area 116 and a vehicle that is about to reach ELoC 118. Each vehicle will provide its own estimates of SLoC 120 and the Transit Time.

During this whole process of estimating TT and SLoC, many messages are exchanged between the selected DSRC-equipped vehicles and central RSU 122 using DSRC-based V2I and/or V2V communication. Please note that the Society of Automotive Engineers (SAE) has specified safety message composition for the DSRC communication in their draft standard SAE J2735. In most embodiments, message formats are used that comply with these standards and contain mandatory fields of the message types such as A La Carte (ACM) and Basic Safety Message (BSM). The messages contain the data fields as specified in J2735 standards and the entire message is encoded and communicated according to the same standards. Additionally, in the back and forth communication between central RSU 122 and DSRC-equipped vehicles, to maintain privacy, all information is exchanged without retaining any vehicle identity information.

Figure 2:
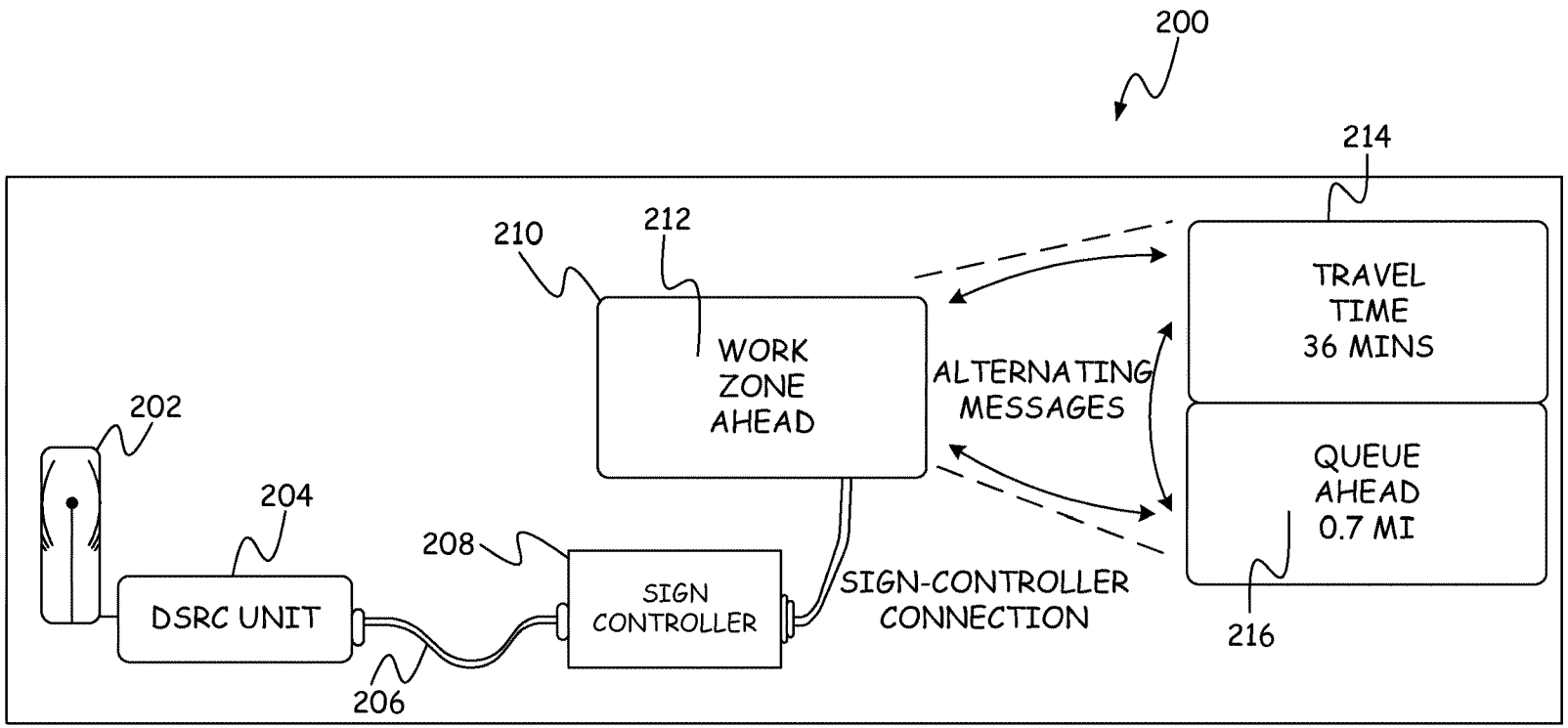
FIG. 2 is a simplified block diagram of a portable road sign.

FIG. 2 provides a simplified block diagram of a DSRC-equipped PCMS 200 in accordance with one embodiment. In FIG. 2, an antenna 202 receives a vehicle-to-vehicle message containing the latest traffic parameters. A DSRC unit 204 decodes and parses the message and formats the decoded message as a Higher Datalink Layer Control (HDLC) encoded message that is sent across a serial link 206 to a sign controller 208. Sign controller 208 uses the HDLC encoded messages to control a sign 210 so that the sign displays alternating messages such as messages 212, 214 and 216. The messages alternate with a few seconds interval, such as 3 seconds for example, because all of the information on the three messages does not fit into the 3 lines×8 characters display matrix that is typical of a PCMS.

The message follows guidelines suggested by MUTCD for using the PCMSs in work zones.

In accordance with one embodiment, sign controller 208 and sign 210 are part of a PCMS made by ADDCO® (an IMAGO® company). This particular PCMS is fully compliant with the National Transportation Communications for ITS Protocol (NTCIP). DSRC unit 204 is not present in the PCMS made by ADDCO®.

The messages are displayed on the display matrix until an updated information message containing a new message and/or new values of TT and SLoC is received. Although text messages are shown in FIG. 2, other types of messages including graphical images may be shown on the display matrix.

In addition, the message displayed on the display matrix is not limited to information provided by RSU 122. For example, in embodiments in which the vehicle-to-vehicle messages received by DSRC unit 204 indicate the location of the SLoC but do not indicate the distance from the DSRC-equipped PCMS to the SLoC, DSRC unit 204 can include a position system that provides the position of the PCMS. DSRC unit 204 uses the position of the PCMS and the position of the SLoC to determine the distance between the PCMS and the SLoC and encodes this distance information in the HDLC message sent to sign controller 208. Thus, the displayed message will include a distance value that was not directly present in the message sent to the vehicles by RSU 122.

Figure 3:
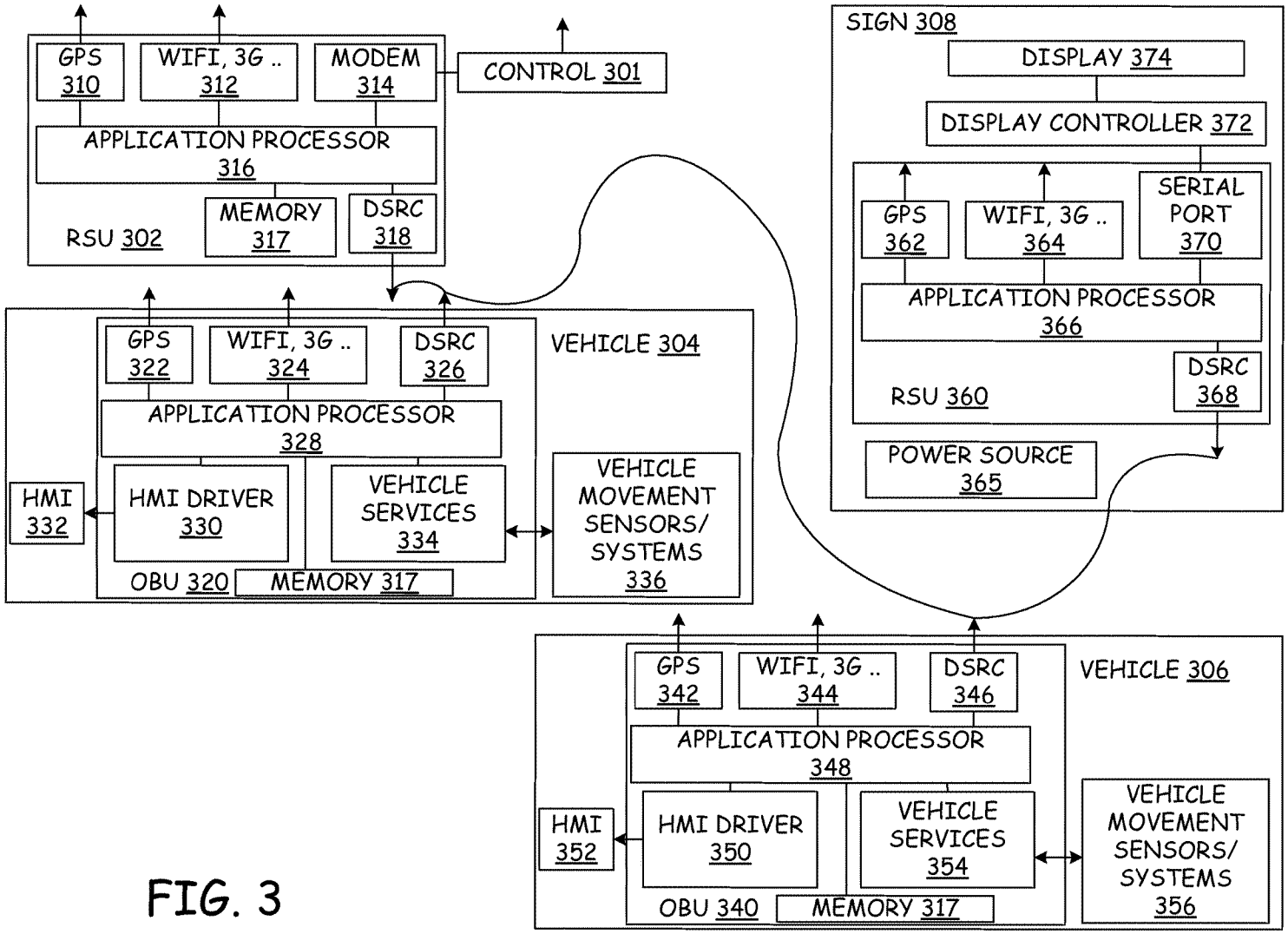
FIG. 3 is a block diagram of a system in accordance with one embodiment.

FIG. 3 provides a block diagram of a roadside unit (RSU) 302, two vehicles 304 and 306, and a portable road sign (DSRC-equipped PCMS) 308 that can be used in accordance with various embodiments.

Roadside unit 302 includes an application processor 316 that executes one or more instructions stored in a memory 317 to communicate with vehicles using vehicle-to-infrastructure communication through a transceiver 318, which in one embodiment is a dedicated short range communication (DSRC) transceiver. Application processor 316 is also able to communicate with a control unit 301 through a wired modem 314 and/or through a wireless modem 312. Roadside unit 302 may also include a position system 310, such as a Global Positioning System, that allows roadside unit 302 to determine its position and to use that position information to determine a distance between roadside unit 302 and positions reported in messages received by transceiver 318.

Transceiver 318 receives messages from one or more vehicles such as Basic Safety Messages (BSMs) and A la Carte messages (ACMs) that indicate the position of the vehicles when the vehicles decelerate at the start of congestion. These messages may be received directly from the reporting vehicle or may be relayed by one or more intermediary vehicles between the reporting vehicle and RSU 302. Processor 316 selects one decelerating vehicle and stores in memory 317 the time and position where the vehicle decelerated as the start of congestion. Processor 316 then monitors the speed of the vehicle through the congestion based on additional messages sent by the vehicle and received by transceiver 318. These messages may come directly from the vehicle or may be relayed by other vehicles to roadside unit 302. When processor 316 determines that the vehicle has reached the end of congestion, the position and the time when the vehicle reached the end of congestion are stored in memory 317. Processor 316 then uses the stored time when the vehicle was at the start of the congestion and the stored time when the vehicle was at the end of the congestion to determine a travel time for the vehicle through the congestion. Processor 316 then constructs a message containing the position of the start of congestion, the position of the end of congestion and the travel time (together referred to as traffic parameters) and transmits the constructed message using transceiver 318. In addition, RSU 302 can generate other messages such as warning messages about lane closures and DUI enforcement. When determining these traffic parameters and transmitting the constructed messages, RSU 302 acts as a stationary host. In other embodiments, a mobile ad hoc host, such as a vehicle, may determine the traffic parameters and transmit the constructed messages.

Vehicle 304 includes an onboard unit 320, also referred to as a vehicle-to-vehicle communication unit, a vehicle movement sensors/system 336 and a human-machine interface 332. Vehicle movement sensors/system 336 provides information about the vehicle such as the current speed of the vehicle, the status of various vehicle components such as tires, lights, brakes, wipers, and the orientation of the tires, for example. This information is provided to a vehicle services module 334 in onboard unit 320, which provides the information to application processor 328. Application processor 328 is able to communicate wirelessly using a wireless modem 324 to receive updates and to convey history information about vehicle 304. Application processor 328 also receives position information from a position system 322, which in FIG. 3 takes the form of a global positioning system that determines the position of onboard unit 320 based on signals provided by satellites.

Application processor 328 is also able to transmit and receive messages using a transceiver 326, which in FIG. 3 takes the form of a DSRC transceiver. Using transceiver 326, onboard unit 320 is able to receive messages such as BSMs and ACMs from other vehicles and RoadSide Units. Processor 328 decodes and interprets the messages to determine the content of the messages, such as the traffic parameters. Processor 328 provides some or all of the message content to a human-machine driver 330, which generates human-machine interface 332 to convey some or all of the information in the message to a person in the vehicle. In addition, processor 328 is able to construct additional information based on the traffic information provided by transceiver 326. For example, when transceiver 326 receives the position of the start of congestion or the position of the end of congestion, processor 328 is able to calculate the distance from the vehicle's current location as determined from position system 322 to both the start of congestion and the end of congestion. This additional information may also be provided to human-machine driver 330 so that it can be conveyed to the user through human-machine interface 332. Processor 328 also retransmits the traffic parameters by creating a new BSM or ACM that is then transmitted by transceiver 326 to another vehicle or to a DSRC-equipped sign using vehicle-to-vehicle communication protocols.

When vehicle 304 is being used by RSU 302 to identify the position of the start of congestion, the position of the end of congestion and the travel time through the congestion, processor 328 periodically generates messages that convey vehicle 304's current position and current speed. Processor 328 can determine the speed of vehicle 304 by using a speed value provided by vehicle movement sensors/systems 336 or by monitoring changes in the location of the vehicle using position values from position system 322. RSU 302 can use this information to identify the Starting Location of Congestion (SLoC). In alternative embodiments, processor 328 determines the SLoC by detecting when vehicle 304 is decelerating and comparing the deceleration to thresholds associated with a start of congestion. Once processor 328 has identified the position of the SLoC, it conveys that information to RSU 302 in a message sent through transceiver 326. Although shown as communicating directly with transceiver 318 of RSU 302 in FIG. 3, it should be understood that at times transceiver 326 will communicate with transceiver 318 of RSU 302 through intermediary vehicles and at other times transceiver 326 will communicate directly with transceiver 318 of RSU 302 depending on the distance between vehicle 304 and RSU 302.

As vehicle 304 moves through the congestion, processor 328 uses transceiver 326 to periodically send BSMs or ACMs indicating vehicle 304's speed and position and these messages are received by RSU 302. When the speed of vehicle 304 reported by processor 328 indicates vehicle 304 has reached the end of the congestion, RSU stores the position information as the end of congestion as discussed above.

Vehicle 306 is similar to vehicle 304 and includes vehicle movement sensors/systems 356, human-machine interface 352 and onboard unit 340. Onboard unit 340 includes position system 342, wireless modem 344, transceiver 346, memory 349, processor 348, human-machine interface driver 350 and vehicle services module 354, which operate in a similar manner to the components of vehicle 304 discussed above. Using transceiver 346, vehicle 306 is able to relay the traffic parameters that have been transmitted by RSU 302 and vehicle 304. The relayed traffic parameters are received by a transceiver 368 in sign 308.

Portable road sign 308 is a hybrid DSRC-PCMS sign that can be moved to different positions along a road and includes a power source 365, a roadside unit (RSU) 360, a display controller 372 and a display 374. RSU 360 acts as a communication link that receives information issued for a vehicle using a communication standard (such as Dedicated Short Range Communications), that generates a message from the received information and that provides the generated message to display controller 372 with instructions to show the generated message on the display. RSU 360 includes an application processor 366, transceiver 368, which in the embodiment of FIG. 3 takes the form of a DSRC transceiver, a position system 362, which in the embodiment of FIG. 3 takes the form of a GPS unit, a wireless modem 364 and a serial port 370. Processor 366 receives the traffic parameters sent by RSU 302 through transceiver 368. These traffic parameters can be received by transceiver 368 directly from RSU 302 or through one or more intermediary vehicles such as vehicles 304 and 306. These traffic parameters include the position of the start of congestion, the travel time through the congestion and optionally the position of the end of congestion. The traffic parameters are converted into messages that are sent to display controller 372 through serial port 370. Display controller 372 then modifies display 374 to show the traffic parameters.

Figure 4:
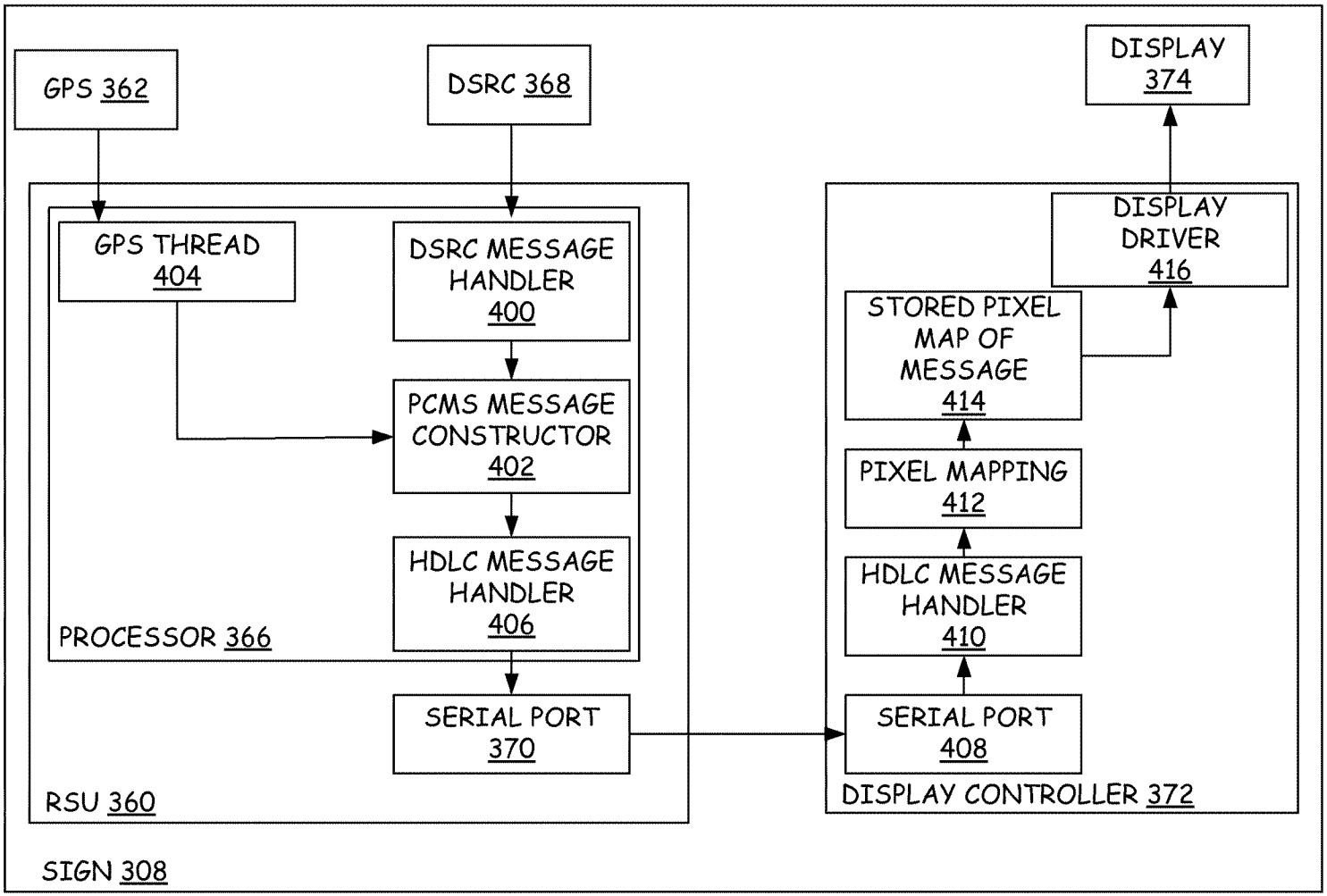
FIG. 4 is a block diagram of components in a portable road sign.

FIG. 4 provides a more detailed block diagram of software and hardware components in RSU 360 and display controller 372. As shown in FIG. 4, a DSRC message handler 400 executed by processor 366 receives the traffic parameters from transceiver 368 and provides them to a PCMS message constructor 402 executed by processor 366. Message constructor 402 takes the position of the start of congestion and a position of sign 308 and determines a distance between sign 308 and the start of congestion. The position of sign 308 is provided by a GPS thread 404 executed by processor 366 that periodically polls position system 362 for the position of sign 308. PCMS message constructor 402 then constructs a set of new messages for display 374. These messages can include a generic "Work Zone Ahead" message, a travel time message that contains the travel time provided in the traffic parameters and a message containing the distance from sign 308 to the start of congestion. a lane closure warning, a DUI enforcement warning, and so forth.

A higher datalink layer control (HDLC) message handler 406 executed by processor 366 then forms a set of commands or instructions to instruct display controller 372 to change the current messages on display 374 to the set of new messages. In accordance with one embodiment, these commands are in a modified HDLC language. HDLC message handler 406 provides the HDLC commands to display controller 372 through serial port 370.

Display controller 372 receives the HDLC commands through a corresponding serial port 408 and a HDLC message handler 410. HDLC message handler 410 executes the HDLC commands and based on the execution of those commands constructs a new set of messages that are then provided to a pixel mapping unit 412. Pixel mapping unit 412 converts each message into a set of pixels for the display and stores the resulting pixel maps 414 in memory thereby effectively storing the messages to be shown on the display. A display driver 416 reads the stored pixel maps 414 and uses the stored maps to drive display 374 so that it displays the messages. In other words, display driver 416 provides signals to display 374 to show at least one stored message on display 374. In accordance with one embodiment, display driver 416 repeatedly displays a sequence of messages that includes: a "Work Zone Ahead" message, a travel time message, a second "Work Zone Ahead" message, a "distance to start of congestion" message. However, other sequences are possible and other warnings may be included in the messages. Further, it is not necessary to include the traffic parameters in the sequence of messages.

Figure 5:
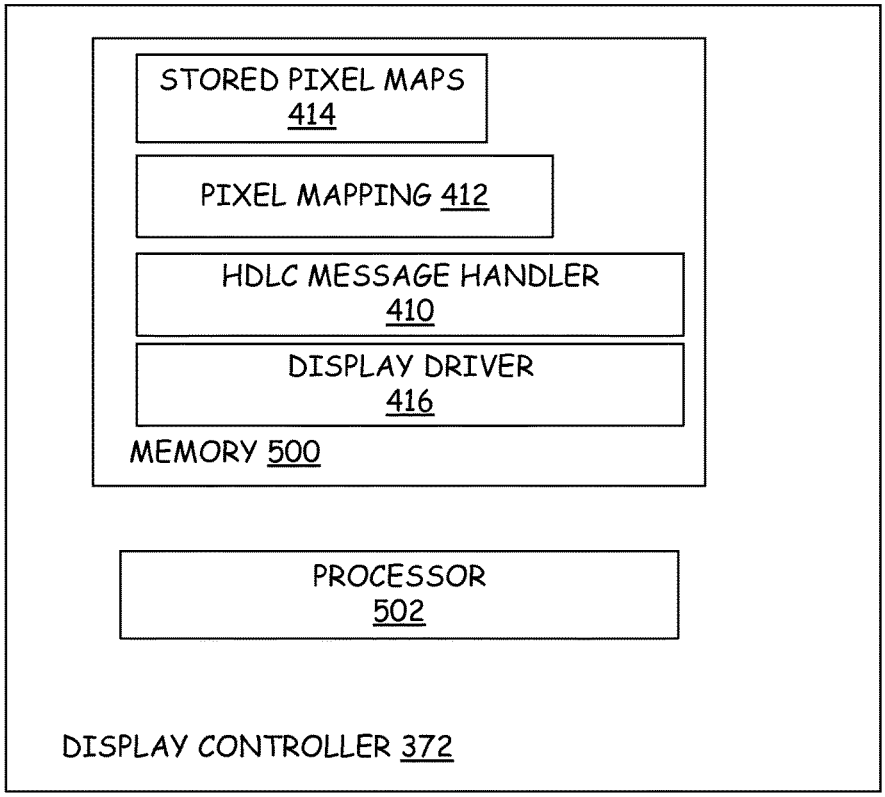
FIG. 5 is a block diagram of an embodiment of a controller in a portable road sign.

In FIG. 4, HDLC message handler 410, pixel mapping 412 and display driver 416 are shown as separate hardware devices. FIG. 5 provides an alternative embodiment where HDLC message handler 410, pixel mapping 412 and display driver 416 are realized as sets of computer-executable instructions that are stored in a memory 500 of display controller 372 and are executed by a processor 502.

In the discussion above, the traffic parameters were determined by RSU 302. In other embodiments, an ad hoc host determines the traffic parameters. The ad hoc host is a vehicle that is approaching the congestion area. As the vehicle decelerates it stores the time and position when the deceleration occurred as the start of congestion. When the vehicle accelerates to its free flow speed, it stores the time and position of the acceleration as the end of congestion. The vehicle then determines the travel time using the stored times when it was at the start of congestion and when it was at the end of congestion. The vehicle then transmits a BSM or ACM indicating the position of the start of congestion, the position of the end of congestion and the travel time for traveling between the start of congestion and the end of congestion. This message is then relayed back through the congestion by DSRC-equipped vehicles so that it can reach one or more DSRC-PCMS hybrid signs, which display the traffic parameters to drivers who do not have a DSRC-equipped vehicle.

Figure 6:
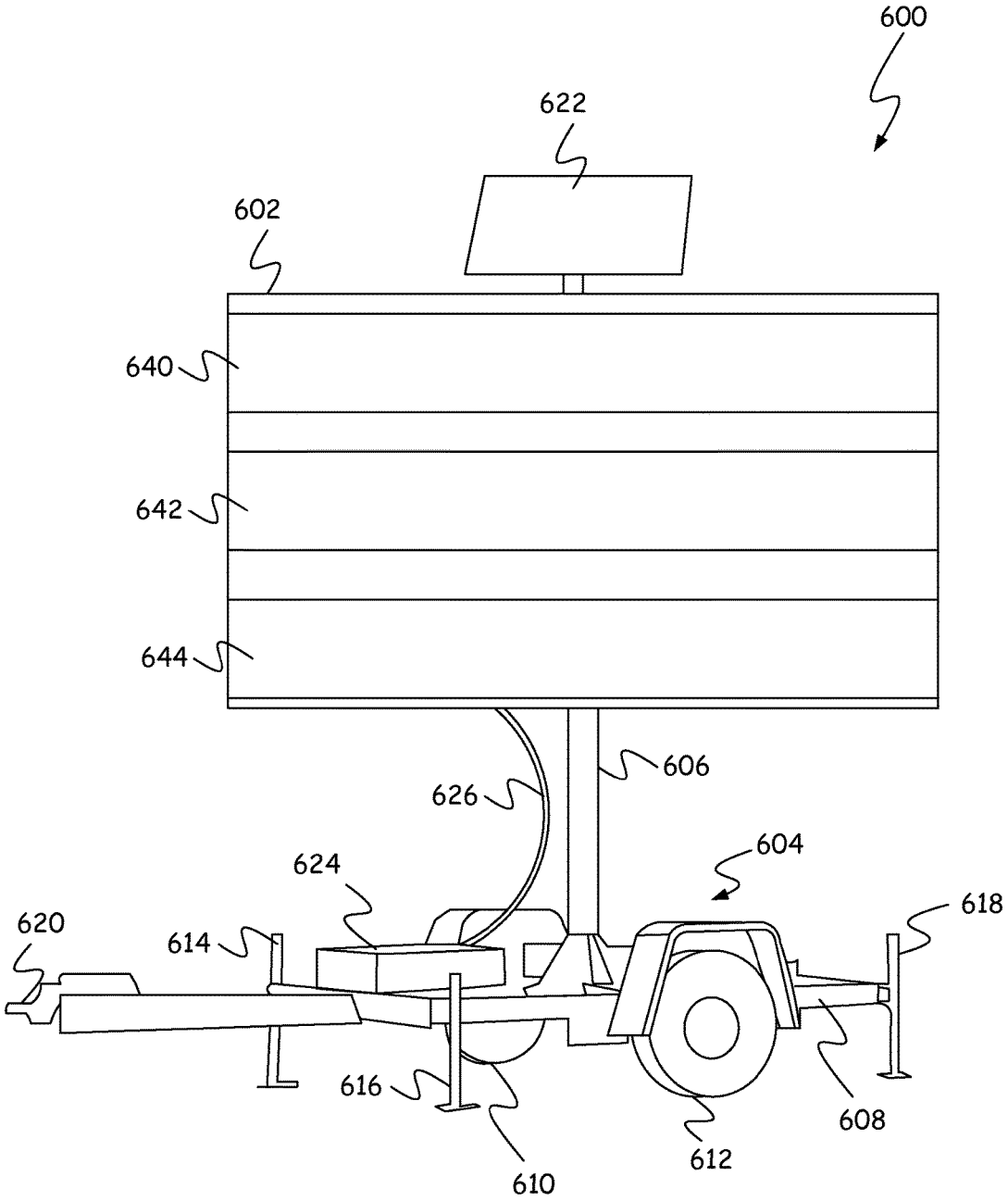
FIG. 6 is a perspective view of an embodiment of a portable road sign.

FIG. 6 provides an example of a DSRC-PCMS hybrid sign 600 under some embodiments. Sign 600 includes a display 602 mounted on a mobile body or trailer 604 by a post 606. Trailer 604 includes a frame 608, wheels 610 and 612, stabilizing jacks 614, 616, and 618, trailer coupler 620, and power and control box 624. Trailer 604 allows sign 600 to be towed by a vehicle so that sign 600 can be moved to different locations such as before an exit on a road. By moving sign 600 to a location before an exit, information about a congested area can be provided to drivers before they reach the exit so that the drivers can take an alternative route to avoid the congestion.

Coupler 620 may be attached to a trailer hitch on a vehicle so that sign 600 can be towed to different locations. Stabilizing jacks 614, 616 and 618 are deployed when sign 600 is in position to stabilize sign 600 and keep sign 600 from rolling.

A solar cell 622 mounted to the top of display 602 produces a current when exposed to sunlight. This current is provided to a battery in power and control box 624 and the battery acts as power source 365 for sign 600. Box 624 also contains RSU 360 and display controller 372. Power and control lines 626 extend between box 624 and display 602 and provide power and pixel values to display 602.

Display 602 includes three rows of pixel regions 640, 642 and 644. Each row contains a plurality of pixels that can be used to display characters and images.

Although embodiments are shown above for a portable changeable message sign, in other embodiments a fixed-position variable-message sign is used. With such fixed-position variable-messages signs, a roadside unit with DSRC communication capability is included in the sign. The roadside unit converts the DSRC messages into one or more messages to be conveyed by a display on the sign. The roadside unit then sends commands to a controller in the fixed-position variable-message sign to change the message displayed by the sign to the one or more messages constructed from the DSRC messages. The roadside unit includes a positioning system such that when constructing the messages for the fixed-position variable-message sign, the roadside unit can construct a message that contains the distance from a position of the fixed-position variable-message sign to the start of congestion.

A newly developed Hybrid PCMS-DSRC information system has been described. The developed system is capable of acquiring important travel parameters such as TT and SLoC using DSRC based V2I and V2V communication and then periodically broadcasting those parameters to DSRC-equipped vehicles and DSRC-equipped PCMSs. In this hybrid system, the DSRC-equipped PCMSs are strategically placed alongside the work zone road and are treated just like DSRC-equipped vehicles except that the DSRC-equipped PCMSs can display the received information to drivers of vehicles that lack DSRC. For this purpose, a DSRC-PCMS interface was developed which helps a PCMS to receive safety messages containing TT and SLoC from a nearby DSRC-equipped vehicle using DSRC based V2V communication.

Although the present invention has been described with reference to preferred embodiments, workers skilled in the art will recognize that changes may be made in form and detail without departing from the spirit and scope of the invention.

What is claimed is:

1. A system comprising:

a road sign receiving a message rebroadcasted by a vehicle on a road and displaying messages based on information in the received message, the information comprising a position of a start of the congestion and a time for travelling to the end of the congestion.

2. The system of claim 1 wherein the road sign constructs and displays a first message that shows the distance to the start of congestion and the road sign constructs and displays a second message that shows the time to travel to the end of the congestion.

3. A system comprising:

a stationary host positioned at an expected end point of congestion that transmits information about congestion through a network of vehicles on a road, the information comprising a position where the congestion starts;

a road sign positioned near the road that receives the information about the congestion from the network of vehicles and converts the information into at least one message displayed on the road sign.

4. The system of claim 3 wherein the road sign converts the position where the congestion starts into a distance from the road sign to the position where the congestion starts.

5. The system of claim 4 wherein the road sign comprises a position system that determines the current position of the road sign.

6. A system comprising:

a portable road sign comprising a position system that provides a value representing the position of the road sign and a processor, the portable road sign receiving a message rebroadcasted by a vehicle on a road using a dedicated short range communication standard and displaying messages based on information in the received message, the information comprising a position of a start of the congestion wherein the processor determines a distance between the position of the road sign and the position of the start of congestion in the received message and wherein displaying messages comprises the road sign displaying the distance.

* * * * *